US006371742B1

(12) United States Patent
Gigon

(10) Patent No.: US 6,371,742 B1
(45) Date of Patent: Apr. 16, 2002

(54) COOLING DEVICE

(75) Inventor: René Gigon, Porrentry (CH)

(73) Assignee: Ateliers Busch S.A., Chevenez (CH)

( * ) Notice: Subject to any disclaimer, the term of this patent is extended or adjusted under 35 U.S.C. 154(b) by 0 days.

(21) Appl. No.: 09/582,335

(22) PCT Filed: Dec. 22, 1998

(86) PCT No.: PCT/CH98/00547

§ 371 Date: Jun. 23, 2000

§ 102(e) Date: Jun. 23, 2000

(87) PCT Pub. No.: WO99/35402

PCT Pub. Date: Jul. 15, 1999

(30) Foreign Application Priority Data

Dec. 30, 1997 (CH) ..... 2979/97

(51) Int. Cl.[7] ..... F01C 21/00

(52) U.S. Cl. ..... 418/2; 418/85; 418/101; 418/201.2; 165/104.21; 165/104.33

(58) Field of Search ..... 418/2, 85, 101, 418/201.1; 165/104.21, 104.33

(56) References Cited

U.S. PATENT DOCUMENTS

| | | | | | |
|---|---|---|---|---|---|
| 2,083,611 | A | | 6/1937 | Marshall | |
| 2,449,110 | A | | 9/1948 | Eells | |
| 2,667,046 | A | | 1/1954 | Densham | |
| 4,222,436 | A | * | 9/1980 | Pravda | 165/105 |
| 4,529,363 | A | * | 7/1985 | Suzuki | 418/83 |
| 4,680,001 | A | * | 7/1987 | Waters | 165/104.21 |
| 4,722,304 | A | | 2/1988 | Hirano | |
| 4,725,210 | A | * | 2/1988 | Suzuki et al. | 418/85 |
| 4,737,087 | A | * | 4/1988 | Hertell | 418/2 |
| 4,929,161 | A | * | 5/1990 | Aoki et al. | 418/85 |
| 4,983,106 | A | * | 1/1991 | Wright et al. | 418/2 |
| 5,028,220 | A | * | 7/1991 | Holdsworth | 418/2 |
| 5,433,590 | A | * | 7/1995 | Klaus et al. | 418/2 |
| 6,066,288 | A | * | 5/2000 | Purstinger | 264/568 |

FOREIGN PATENT DOCUMENTS

| | | | | |
|---|---|---|---|---|
| EP | 489628 B1 | * | 6/1992 | 418/85 |
| GB | 2017216 | * | 10/1979 | 418/85 |
| JP | 56-006091 A | * | 1/1981 | 418/85 |
| JP | 57 000384 A | | 1/1982 | |
| JP | 57-016217 A | * | 1/1982 | 123/41.56 |
| JP | 60-256589 A | * | 12/1985 | 418/85 |
| JP | 62-007902 A | * | 1/1987 | 418/2 |
| JP | 63 162980 A | | 7/1988 | |
| JP | 63 201396 A | | 8/1988 | |
| JP | 01-300073 A | * | 12/1989 | 417/228 |
| JP | 4-232395 A | * | 8/1992 | 418/2 |

* cited by examiner

*Primary Examiner*—Thomas Denion
*Assistant Examiner*—Theresa Trieu
(74) *Attorney, Agent, or Firm*—Clifford W. Browning; Woodard, Emhardt, Naughton, Moriarty & McNett

(57) ABSTRACT

The invention concerns a cooling device wherein the chamber (2) represents cooling channels arranged in the thickness of the pump cylinder walls. The steam flux (7) generated by the heat to be evacuated reaches the upper end of the condenser (1) and comes out in the form of water in the return branch (6) into the chamber (2). An air flow (5) driven by the fan (3) activates condensation. The sensor (17) acts as a control and safety element.

34 Claims, 2 Drawing Sheets

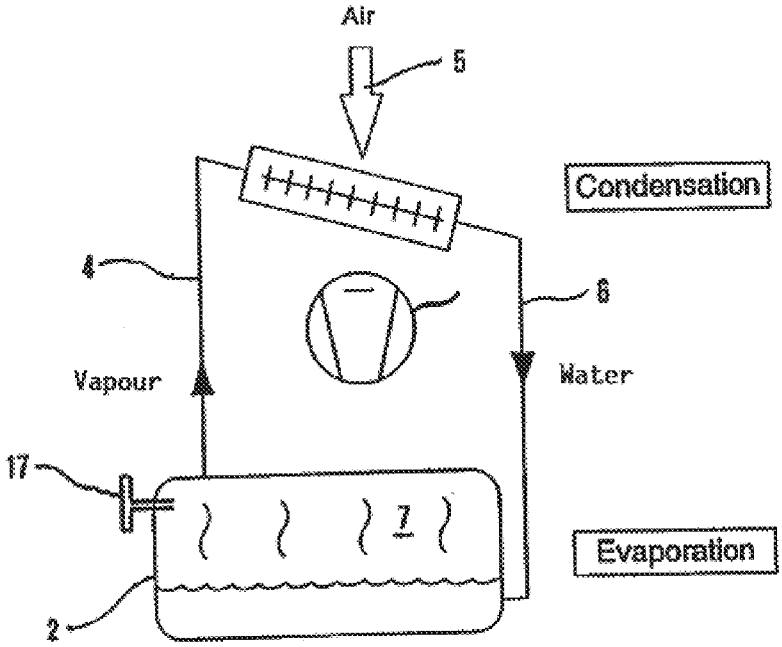
FIG.1
FIG.2
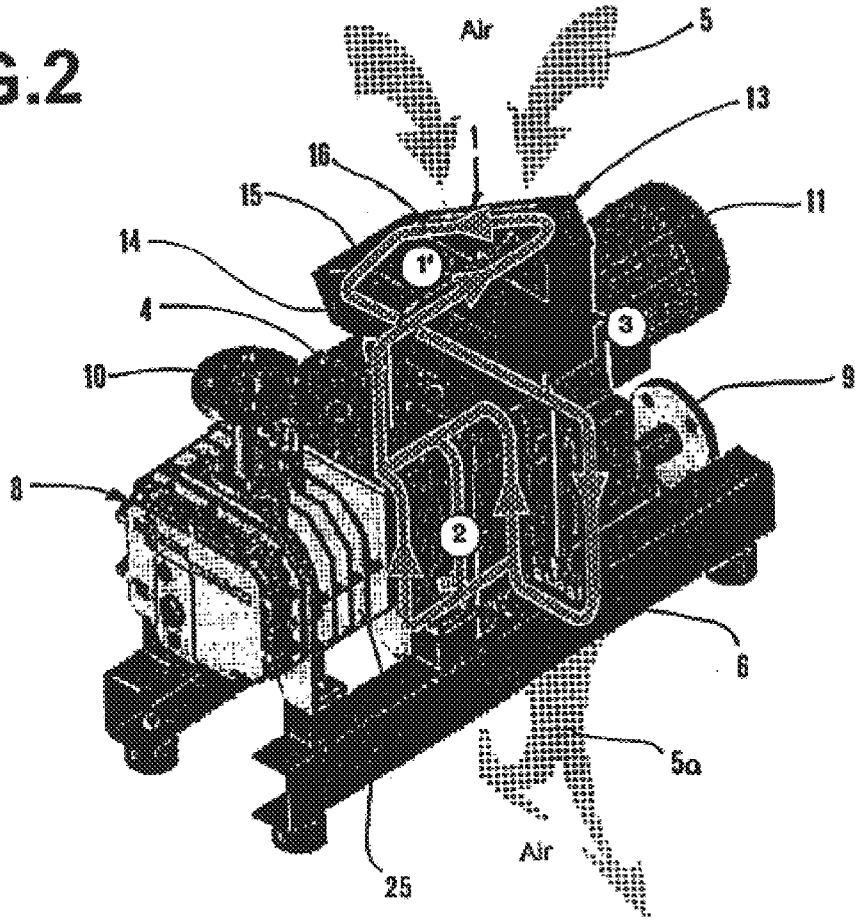

COOLING DEVICE

The present invention relates to a closed circuit cooling device for a vacuum pump with moving elements housed in a pump body, the closed circuit having cooling chambers with a fluid flowing through, made in the walls of the pump body, a heat exchanger supplied on one side with the cooling fluid coming from said chambers and on the other with an air flow, and a fluid return between the exchanger and the cooling chambers.

The device is intended in particular for a vacuum pump with two twin screws housed in one and the same cylinder, engaging with one another, and having a motor connected to one of the screws.

Vacuum pumps designed for high performance require cooling, and implementation of cooling devices in accordance with the above definition is known. In general the cooling fluid is water. These closed circuit devices are distinguishable from lost water systems, which at present are no longer acceptable for ecological and economic reasons. They are also distinguishable from direct air systems which are inadequate given the requirements of vacuum pumps from the point of view of the amounts of heat to be removed.

However, the closed circuit devices known until now also have failings when it is a question of equipping vacuum pumps of high performance and compact construction, as are the pumps with two twin screws housed in one and the same cylinder, especially when the profile of the screws is designed so as to obtain maximum efficiency, with a high speed of rotation and as small a size as possible. At any rate, the known closed circuit cooling systems have the drawback of requiring a circulating pump. Moreover, the high performance pumps require a radiator of particularly large dimensions.

The aim of the present invention is therefore to create a cooling device which avoids the above-mentioned failings.

To that end, the device according to the invention is characterised in that the heat exchanger is a condenser, in that the flow of cooling air is generated by a fan driven by the pump motor, and in that the cooling chambers are dimensioned so that the fluid has reached its boiling point at the output thereof.

According to one embodiment, the fan is mounted directly on the shaft of one of the screws and may be placed between the driven screw and the motor.

The condenser can be of the crossed circulation type and have a chamber containing a network of tubes, at least part of which is in an inclined position so as to have the vaporized cooling fluid flowing through from top to bottom, said chamber capable of having a lateral opening in its upper part for input of the air flow and, in its lower part, a connection to the input duct of the fan.

The invention also relates to a vacuum pump with two twin screws housed in one and the same cylinder, engaging with one another, and having a motor connected to one of the screws, and having a cooling device according to the invention.

There will be described below, by way of example, one embodiment of the object of the invention, referring to the accompanying drawing in which:

FIG. 1 is a schematic view of the device,

FIG. 2 is a perspective view of the pump assembly with its cooling circuit.

Figure 3:
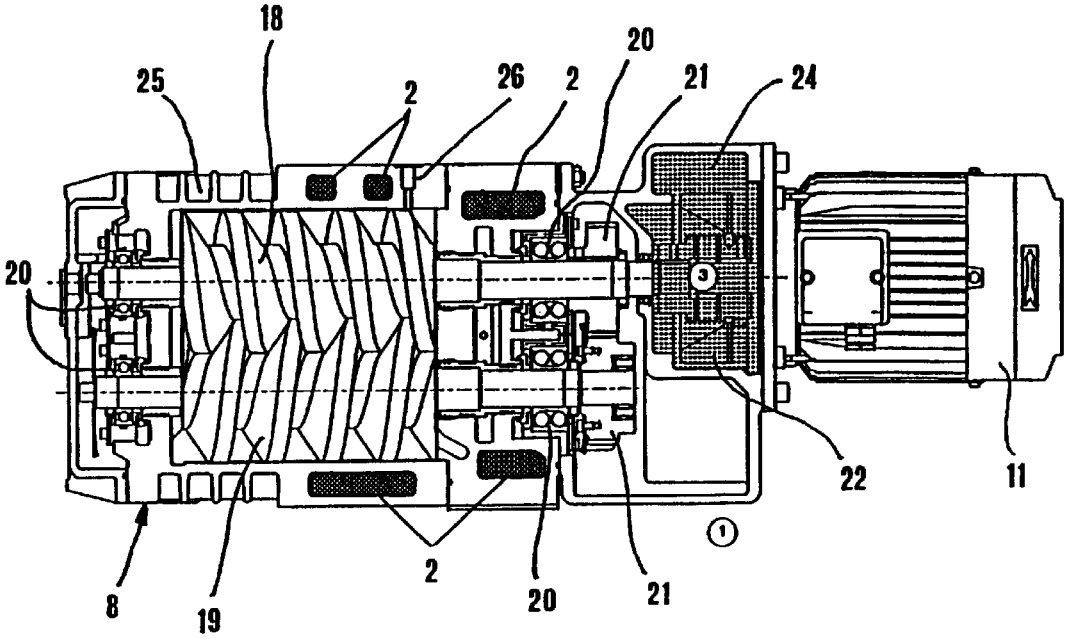
FIG. 3 is a sectional view through a horizontal plane at screw axis level, of the pump of FIG. 2.

The vacuum pump cooling device depicted in the drawing operates as a closed circuit according to the vaporization or boiling principle.

The means used for this are depicted schematically in FIG. 1. The main elements consist simply of a condenser 1 disposed in the upper part of the device and a set of cooling chambers 2, an expansion vessel 1' being disposed between the cooling chambers and the condenser. The cooling chambers are disposed in the walls of the cylindrical pump body and in its cover. They are dimensioned so that the heat given off by the vacuum pump in normal operation brings the cooling fluid, which is water, to boiling temperature, that is 100° C. if the pressure is close to atmospheric pressure. There therefore forms in the chambers 2 a flow of water vapour 7 which is conveyed by pipes 4 to the input, that is to say to the upper part, of the condenser 1. Under the effect of an air flow 5 which passes through the condenser 1 in crossed circulation, the water vapour condenses in the lower part of the condensation tubes and returns by gravity through the return pipe 6 to the input of the chambers 2. In order to create forced circulation of the air flow 5, a fan 3 is incorporated in the pump, driven by the pump motor. A temperature sensor 17 monitors the operation of the assembly and intervenes in the event of an abnormal situation. According to a variant, the assembly can be constructed so that the air flow passes through the condenser in the opposite direction to that depicted by the arrows in FIG. 2.

FIG. 2 shows the constructional disposition of the elements described above. The pump cylinder 8 has a horizontal disposition with a discharge pipe 9 and an inlet pipe 10. A motor 11 directly drives the shaft of one of the screws. Water jackets 2 are made in the form of channels in the thickness of the walls of the cylinder 8 and the vapour produced is brought by the pipe 4, outside the cylinder, to the condenser 1. Said condenser has a chamber 13 whose lower part 14 rests on the cylinder 8, in transverse disposition, and whose obliquely disposed upper part 15 is connected by its upper end to the vapour pipe 4. In the inclined part 15 and in the transverse part 14 of the chamber 13 there are disposed networks of tubes which end at the return duct 6.

The inclined upper wall of the chamber 13 has an opening 16 made in it, through which there enters the air flow 5 whose output is represented under the pump unit by the arrows 5*a*.

For further details, reference will now be made to FIG. 3 which shows the cylinder 8 cut through a horizontal plane at the level of the axis of the screws 18 and 19, supported by the four bearings 20 and connected to one another by the pinions 21. The shaft of the screw 18 is extended in the direction of the motor 11 to which it is directly coupled and this extension carries the wheel 22 of the fan 3 whose output volute 24 opens downward, under the pump. There should be noted, in the thickness of the lateral walls of the cylinder 8, the water jackets 2 which surround the turns and bearings of the screws 18 and 19 close to the discharge, where the maximum amount of heat develops. In the embodiment described here, the turns of the screws close to the inlet turn in a part of the cylinder which is provided with ambient air cooling fins 25. Furthermore, the wall of the cylinder 8 has passing through it, in the vicinity of the jackets 2, a safety valve device 26 making it possible, if required, to break the vacuum in the space to be evacuated, possibly by making nitrogen enter therein. The temperature sensor 17 is placed immediately above this safety device. Should excessive heating arise in the pump, which is likely to make the level of the water/vapour boundary layer in the jackets 2 fall, this sensor can either trigger an alarm, or stop the motor or intervene in some other way.

The device described has the combined advantage of a very high cooling efficiency in a small volume, and great simplicity. The high efficiency is due to the fact that the heat is captured in the cooling fluid by the change of state thereof. In the case of water, it is known that the vaporization heat is 2250 kJ/kg and that, if the pressure remains close to atmospheric pressure, the temperature will remain constantly at 100° C. as long as not all the water has vaporized. In order to calculate the system data, a start will be made with the power Pm (watts) which the motor has to supply. The release of heat comes, on the one hand, from the losses in the motor and the friction in the pump, and, on the other hand, from the compression of the evacuated gas. In fact, for the heat Pc (watts) to be removed, it is necessary to allow for a value of:

$$Pc=0.8\ Pm$$

The above figures make it possible to calculate the vapour flow rate which must be produced to remove this heat under stable conditions, and consequently to dimension the jackets 2. For calculating the dimensions of the condenser and the fan, an ambient air temperature of 30 to 50° C. will be taken into account.

The practical tests showed that, with these conditions, the cooling device worked perfectly reliably while being much smaller in size than a water circulating cooler of the usual type. The cooling circuit is created entirely by gravity, without the circulation having to be forced. Since the condenser fan is driven directly by the pump motor, no additional drive is necessary. Moreover, the good transmission of heat by the condensation effect makes it possible to use a small-sized condenser. This cooling device has proved completely effective with pumps of the type described above, whose screw threads have a conformation specially designed for achieving a very high extraction throughput.

In order to avoid any problems of freezing of the cooling liquid, when the pumps are intended to be used in places where the temperature can fall below 0° C., a mixture of 25% ethylene glycol or propylene glycol and 75% water or any other mixture of water and suitable antifreeze liquid can be used as the cooling liquid.

What is claimed is:

1. A closed circuit cooling device for a vacuum pump, said vacuum pump having a body and moving elements housed in said pump body, the closed circuit having cooling chambers with a fluid flowing through, made in the walls of the pump body, a heat exchanger supplied on one side with the cooling fluid coming from said chambers and on the other with an air flow, and a fluid return between the exchanger and the cooling chambers, wherein the cooling chambers are dimensioned so that the fluid has reached its boiling point at the output thereof, wherein the heat exchanger is a condenser disposed above the pump body, the fluid return taking place by gravity, wherein the flow of cooling air is generated by a fan driven by the pump motor, wherein the condenser is of the crossed circulation type and has a chamber containing a network of tubes, at least part of which is in an inclined position so as to have the vaporised cooling fluid flowing through from top to bottom, said chamber having a lateral opening in its upper part for input of the air flow and, in its lower part, a connection to the input duct of the fan.

2. A device according to claim 1, wherein the fan is incorporated in the pump and directly coupled to the pump motor.

3. A device according to claim 2, wherein the condenser is of the crossed circulation type and has a chamber containing a network of tubes, at least part of which is in an inclined position so as to have the vaporised cooling fluid flowing through from top to bottom, said chamber having a lateral opening in its upper part for input of the air flow and, in its lower part, a connection to the input duct of the fan.

4. A device according to claim 3, wherein the cooling fluid is water.

5. A device according to claim 4, wherein the circuit is arranged according to the amount of heat to be removed so that the pressure of the water is close to atmospheric pressure, the boiling temperature then being around 100° C.

6. A device according to claim 5, further comprising a temperature sensor capable of triggering an alarm signal in the event of a limit value being exceeded.

7. A device according to claim 1, wherein the cooling fluid is water.

8. A device according to claim 7, wherein the circuit is arranged according to the amount of heat to be removed so that the pressure of the water is close to atmospheric pressure, the boiling temperature then being around 100° C.

9. A device according to claim 1, wherein the cooling fluid is water mixed with an antifreeze liquid.

10. A device according to claim 1, further comprising a temperature sensor capable of triggering an alarm signal in the event of a limit value being exceeded.

11. A vacuum pump comprising a cooling device according to claim 1.

12. A vacuum pump with two twin screws housed in one and the same cylinder, engaging with one another, and having a motor connected to one of the screws, and comprising a cooling device according to claim 1.

13. A vacuum pump according to claim 12, wherein said fan is mounted directly on the shaft of one of the screws.

14. A vacuum pump according to claim 13, wherein said cooling chambers surround the turns and bearings of the screws close to the discharge of the pump.

15. A vacuum pump according to claim 12, wherein the fan is placed between the driven screw and the motor.

16. A vacuum pump according to claim 15, wherein said cooling chambers surround the turns and bearings of the screws close to the discharge of the pump.

17. A vacuum pump according to claim 12, wherein said cooling chambers surround the turns and bearings of the screws close to the discharge of the pump.

18. A vacuum pump according to claim 17, wherein the part of the pump body surrounding the turns of the screws close to the inlet of the pump is provided with cooling fins.

19. A closed circuit cooling device for cooling a vacuum pump, said vacuum pump comprising a pump body and moving elements housed in said pump body, the closed circuit having cooling chambers with a fluid flowing through, made in the walls of the pump body, a heat exchanger supplied on one side with the cooling fluid coming from said chambers and on the other with an air flow, and a fluid return between the exchanger and the cooling chambers, wherein the cooling chambers are dimensioned so that the fluid has reached its boiling point at the output thereof, wherein the heat exchanger is a condenser disposed above the pump body, the fluid return taking place by gravity, and wherein the flow of cooling air is generated by a fan driven by the pump motor, wherein the fan is incorporated in the pump and directly coupled to the pump motor, and wherein the condenser is of the crossed circulation type and has a chamber containing a network of tubes, at least part of which is in an inclined position so as to have the vaporised cooling fluid flowing through from top to bottom, said chamber having a lateral opening in its upper part for input of the air flow and, in its lower part, a connection to the input duct of the fan.

20. A device according to claim 19, wherein the cooling fluid is water.

21. A device according to claim 20, wherein the circuit is arranged according to the amount of heat to be removed so that the pressure of the water is close to atmospheric pressure, the boiling temperature then being around 100° C.

22. A device according to claim 21, further comprising a temperature sensor capable of triggering an alarm signal in the event of a limit value being exceeded.

23. A vacuum pump comprising a vacuum pump motor, a vacuum pump body and moving elements housed in said vacuum pump body, and a closed circuit cooling device for cooling said vacuum pump, the closed circuit comprising cooling chambers with a cooling fluid flowing through, made in the walls of the vacuum pump body, a heat exchanger supplied on one side with the cooling fluid coming from said chambers and on the other with an air flow, and a cooling fluid return between the heat exchanger and the cooling chambers, wherein the cooling chambers are dimensioned so that the cooling fluid has reached its boiling point at the output thereof, wherein the heat exchanger is a condenser disposed above the vacuum pump body, said cooling fluid return taking place by gravity, and wherein the air flow supplied to said heat exchanger is generated by a fan driven by said vacuum pump motor.

24. A vacuum pump according to claim 23, wherein the fan is incorporated in said vacuum pump and directly coupled to the vacuum pump motor.

25. A vacuum pump according to claim 23, wherein the cooling fluid is water and wherein the circuit is arranged according to the amount of heat to be removed so that the pressure of the water is close to atmospheric pressure, the boiling temperature then being around 100° C.

26. A vacuum pump according to claim 23, wherein the cooling fluid is water mixed with an antifreeze liquid.

27. A vacuum pump according to claim 23, further comprising a temperature sensor capable of triggering an alarm signal in the event of a limit value being exceeded.

28. A vacuum pump according to claim 23, with two twin screws housed in one and the same cylinder, engaging with one another, and having said vacuum pump motor connected to one of the screws.

29. A vacuum pump according to claim 28, wherein said fan is mounted directly on the shaft of one of the screws.

30. A vacuum pump according to claim 29, wherein said cooling chambers surround the turns and bearings of the screws close to the discharge of the pump.

31. A vacuum pump according to claim 28, wherein the fan is placed between the driven screw (18) and the motor.

32. A vacuum pump according to claim 31, wherein said cooling chambers surround the turns and bearings of the screws close to the discharge of the pump.

33. A vacuum pump according to claim 28, wherein said cooling chambers surround the turns and bearings of the screws close to the discharge of the pump.

34. A vacuum pump according to claim 33, wherein the part of the pump body surrounding the turns of the screws close to the inlet of the pump is provided with cooling fins.

* * * * *